US010598099B2

(12) United States Patent
Wagner et al.

(10) Patent No.: US 10,598,099 B2
(45) Date of Patent: Mar. 24, 2020

(54) METHOD FOR OPERATING A RECIPROCATING INTERNAL COMBUSTION ENGINE

(71) Applicant: Daimler AG, Stuttgart (DE)

(72) Inventors: Marc Oliver Wagner, Esslingen am Neckar (DE); Alexander Zink, Esslingen (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 15/106,188

(22) PCT Filed: Dec. 4, 2014

(86) PCT No.: PCT/EP2014/003244
§ 371 (c)(1),
(2) Date: Jun. 17, 2016

(87) PCT Pub. No.: WO2015/090522
PCT Pub. Date: Jun. 25, 2015

(65) Prior Publication Data

US 2016/0319753 A1 Nov. 3, 2016

(30) Foreign Application Priority Data

Dec. 20, 2013 (DE) ..... 10 2013 022 037

(51) Int. Cl.
*F02D 13/04* (2006.01)
*F02D 13/02* (2006.01)
(Continued)

(52) U.S. Cl.
CPC ..... *F02D 13/0273* (2013.01); *F01L 13/06* (2013.01); *F02D 13/04* (2013.01);
(Continued)

(58) Field of Classification Search
CPC .... F02M 26/43; F02M 2200/26; F02M 26/42; F02M 13/0273; F02M 13/04;
(Continued)

(56) References Cited

U.S. PATENT DOCUMENTS 4,592,319 A 6/1986 Meistrick
4,741,307 A * 5/1988 Meneely ..... F01L 13/06 123/321
(Continued)

FOREIGN PATENT DOCUMENTS

DE 39 00 739 C2 7/1990
DE 696 29 782 T2 7/2004
(Continued)

OTHER PUBLICATIONS

PCT/EP2014/00324, International Search Report dated Jun. 15, 2015 (Two (2) pages).
(Continued)

*Primary Examiner* — David Hamaoui
(74) *Attorney, Agent, or Firm* — Crowell & Moring LLP

(57) ABSTRACT

A method for operating a reciprocating internal combustion engine in an engine braking mode of operation is provided. The method includes closing, for a first time, at least one exhaust valve of at least one cylinder in the engine braking mode of operation within a working cycle, and opening for a first time, and closing, for a second time, the at least one exhaust valve of the at least one cylinder, and opening for a second time to thereby discharge compressed gas in the cylinder via a piston of the cylinder from the cylinder. After the first opening and before the second closing, the exhaust valve is kept open, until the cylinder is filled with gas which flows through at least one exhaust channel from at least one second cylinder of the reciprocating internal combustion engine.

6 Claims, 3 Drawing Sheets

(51) Int. Cl.
*F02M 26/43* (2016.01)
*F02M 26/42* (2016.01)
*F01L 13/06* (2006.01)

(52) U.S. Cl.
CPC ..... *F02M 26/42* (2016.02); *F02M 26/43* (2016.02); *F02D 13/0276* (2013.01)

(58) Field of Classification Search
CPC ..... F02M 13/0276; F02D 13/04; F02D 13/43; F02D 13/0273; F02D 13/0276; F01L 13/06
See application file for complete search history.

(56) References Cited

U.S. PATENT DOCUMENTS 4,981,119 A * 1/1991 Neitz ..... F02D 13/04 123/321
5,146,890 A * 9/1992 Gobert ..... F01L 13/06 123/321
5,526,784 A * 6/1996 Hakkenberg ..... F01L 13/06 123/321
5,619,964 A 4/1997 Feucht
5,724,939 A * 3/1998 Faletti ..... F01L 13/06 123/321
6,000,374 A * 12/1999 Cosma ..... F01L 1/2411 123/321
6,170,474 B1 * 1/2001 Israel ..... F02D 13/04 123/568.14
6,257,213 B1 * 7/2001 Maeda ..... F01L 13/06 123/321
6,321,717 B1 * 11/2001 Faletti ..... F02D 13/04 123/321
6,325,043 B1 * 12/2001 Meistrick ..... F01L 13/06 123/321
6,732,685 B2 * 5/2004 Leman ..... F01L 9/02 123/198 F
6,805,093 B2 * 10/2004 Zsoldos ..... F02M 26/01 123/321
6,827,067 B1 * 12/2004 Yang ..... F01L 1/08 123/568.14
7,013,867 B2 * 3/2006 Rammer ..... F01L 13/065 123/321
7,150,272 B2 * 12/2006 Persson ..... F01L 1/18 123/568.14
7,225,610 B2 * 6/2007 Kemmner ..... F01L 1/34 60/274
7,500,475 B2 * 3/2009 Raymond ..... F02D 13/0207 123/316
7,568,465 B1 * 8/2009 Wiley ..... F02D 13/0246 123/320
8,215,292 B2 * 7/2012 Bryant ..... F01L 1/053 123/1 R
8,261,533 B2 * 9/2012 Demura ..... F02D 41/008 123/443
8,800,531 B2 * 8/2014 Wiley ..... B60T 1/062 123/321
8,967,120 B2 * 3/2015 Furukawa ..... F02D 13/06 123/481
9,115,654 B2 8/2015 Schnell
9,371,780 B2 * 6/2016 Toth ..... F01L 1/181
2004/0250802 A1 * 12/2004 Yang ..... F01L 1/08 123/568.14

FOREIGN PATENT DOCUMENTS

DE 697 18 115 T2 7/2004
DE 10 2010 008 928 A1 8/2011
EP 0 961 018 B1 12/1999
JP 4016141 B2 12/2007
WO WO 2013/054650 A1 4/2013

OTHER PUBLICATIONS

German Search Report issued in German counterpart application No. 10 2013 022 037.8 dated Mar. 27, 2014, with Statement of Relevancy (Six (6) pages).
Japanese-language Office Action issued in counterpart Japanese Application No. 2016-540537 dated Jun. 6, 2017 with partial English translation (Four (4) pages).

* cited by examiner

METHOD FOR OPERATING A RECIPROCATING INTERNAL COMBUSTION ENGINE

BACKGROUND AND SUMMARY OF THE INVENTION

The invention relates to a method for operating a reciprocating internal combustion engine.

Such a method of operating a reciprocating internal combustion engine in an engine braking mode of operation is known from U.S. Pat. No. 4,592,319. In the engine braking mode of operation, the reciprocating internal combustion engine is used as a brake, that is, as an engine brake, for example, for braking a motor vehicle. When driving downhill, for example, the reciprocating internal combustion engine is used during the engine braking mode of operation to at least substantially maintain a constant speed of the motor vehicle or to prevent the speed of the motor vehicle from increasing excessively. By using the reciprocating internal combustion engine as an engine brake, a service brake of the motor vehicle can be preserved. In other words, due to the use of the reciprocating internal combustion engine as an engine brake, the application of the service brake can be avoided or kept low.

To this end, in the method it is provided that the reciprocating internal combustion engine is used or operated as a decompression brake. In other words, the reciprocating internal combustion engine is operated in the engine braking mode of operation in the manner of a decompression brake, which is well-known from the general prior art. As part of the engine braking mode of operation, at least one exhaust valve of at least one combustion chamber in the form of a cylinder of the reciprocating internal combustion engine is closed for the first time within a working cycle. As a result, by means of a cylinder piston, gas, such as fresh air, present in the cylinder, may be compressed. Following the first closing, the exhaust valve is opened so that the air compressed by the piston is vented from the cylinder particularly in an abrupt way. By this discharge of the compressed air, the energy stored in the compressed air, which was transmitted by the piston, can no longer be used to move the piston from its top dead center to its bottom dead center or assist in such a movement. In other words, the compression energy is drained at least for the most part unused out of the cylinder. Since the piston or the reciprocating internal combustion engine has to expend work to compress the gas in the cylinder, which work cannot be used for moving the piston from the top dead center to the lower dead center as a result of opening of the exhaust valve, the motor vehicle can be braked.

The first or initial opening of the exhaust valve is followed by a second closing. In other words, the exhaust valve is closed a second time after the first opening. Therefore, gas still present in the cylinder may be compressed again by the piston. After the second closing, the exhaust valve is opened for a second time, so that the compressed gas may also be discharged a second time from the cylinder, without the compression energy stored in the gas being exploited for moving the piston from its top dead center to its bottom dead center. This at least double opening and closing is performed within a working cycle and allows the discharging of the compressed gas in the cylinder by the piston of the same cylinder.

The piston is pivotally coupled via a connecting rod to a crankshaft of the reciprocating internal combustion engine. The piston is translationally movable relative to the cylinder within the cylinder, wherein the piston moves from its bottom dead center to its top dead center. As a result of the pivoting coupling with the crankshaft, translational movements of the piston are converted into a rotational movement of the crankshaft, so that the crankshaft rotates about a rotational axis. A "working cycle" in a four-stroke engine has exactly two complete revolutions of the crankshaft. This means that one cycle of the crankshaft includes exactly a crank angle of 720 degrees. Within this 720-degree crank angle (°CA) the piston moves twice at its top dead center and twice at its bottom dead center. In a two-stroke engine, the "working cycle" is exactly one revolution of the crankshaft, i.e., a 360-degree crank angle (°CA).

The engine braking mode of operation differs in particular from a normal operation in that the reciprocating internal combustion engine is operated in the engine braking mode of operation without fuel injection, in which the reciprocating internal combustion engine is driven by wheels of the motor vehicle. In normal operation, however, the reciprocating internal combustion engine is operated in a so-called traction mode in which the wheels are driven by the reciprocating internal combustion engine. Moreover, in the normal mode of operation, a fired mode is used, in which not only air but also fuel is introduced into the cylinder. This results in (in the normal operation mode) a fuel-air mixture which is ignited and burnt.

In the engine braking mode of operation, however, no fuel is introduced into the cylinder, so that the reciprocating piston combustion engine in the engine braking mode of operation is operated in an unfired condition.

The object of the present invention is therefore to develop a method of the aforementioned kind such that a particularly high braking performance can be realized.

In order to develop a method such that a particularly high braking performance can be achieved in the engine braking mode of operation, according to the invention, the exhaust valve is kept open after the first opening and before the second closing, until the cylinder is filled with gas, which flows in particular on an exhaust side of the reciprocating internal combustion engine via at least one exhaust channel from at least one second cylinder, which is different from the first cylinder, of the reciprocating internal combustion engine. In other words, the invention proposes to introduce gas from at least one second cylinder into the first cylinder and thereby charge the first cylinder with the gas from the second cylinder. Thereby at least a so-called reverse charging can be performed, after a first decompression cycle of the first cylinder. The exhaust valve of the first cylinder then closes in time for the second time, so that the gas now present in the first cylinder and originating from the second cylinder is compressed by the piston of the first cylinder. Then, the exhaust valve of the first cylinder can be opened for the second time, so that the first cylinder performs a second decompression cycle and the energy stored in the compressed gas cannot be used for returning the piston of the first cylinder from its top dead center to its bottom dead center.

The exhaust valve of the first cylinder therefore performs, within a working cycle, at least two successive decompression strokes, whereby the two decompression cycles of the first cylinder are performed. The second decompression cycle is charged twice or multiple times, since during the second decompression cycle, the gas from the second cylinder is in the first cylinder. Due to this charging of the second decompression cycle, a particularly high engine brake power may be provided in the engine braking mode. The second decompression cycle or stroke may be provided so that the pressure in the first cylinder cannot surpass the value, against which at least one intake valve of the first cylinder can permanently open.

With respect to conventional valve controls in four-stroke engines in the engine brake mode, a considerable increase of engine braking power can be provided by the inventive method, in particular in a lower speed range.

A further embodiment is characterized in that in the engine braking mode, within a working cycle, at least one second exhaust valve of the second cylinder is closed for a first time, then opened for a first time, then closed for a second time and then opened for a second time, in order to discharge gas compressed in the second cylinder from the second cylinder by means of a second piston of the second cylinder. This means that the second cylinder or the second exhaust valve of the second cylinder is operated like the first cylinder or the first exhaust valve of the first cylinder.

In this case, the first cylinder is filled with at least a portion of the gas discharged by the second cylinder, while the second exhaust valve of the second cylinder, after its second opening and before its first closing or after its first opening and before its second closing, is at least partially open. Due to the fact that the second exhaust valve and the first exhaust valve are at least partially open, the gas compressed by the second piston may vent on the discharge or exhaust side of the reciprocating internal combustion engine from the second cylinder and may flow via at least one exhaust channel of the first cylinder into the first cylinder. In this way, a decompression cycle or a decompression stroke of the second cylinder or of the second exhaust valve is used for charging the first cylinder for its second decompression cycle. Due to this charging, a particularly high air quantity is provided in the first cylinder by its second decompression stroke, therefore providing a particularly high engine braking power.

A particularly high charging of the first cylinder may be accomplished by the fact that the exhaust valve of the first cylinder, after the first opening and before the second closing, is kept open, until the first cylinder is filled with respective gas, which flows from the second cylinder, on the exhaust side, through at least a respective exhaust channel, and from at least one third cylinder of the reciprocating internal combustion engine. This means that the first cylinder is charged with gas not only from the second cylinder, but also with gas from the third cylinder, so that a particularly high engine braking power is achieved.

In a further advantageous embodiment of the invention, it is provided that in the engine braking mode, within a working cycle, at least a second exhaust valve of the second cylinder is closed for a first time, then is opened for a first time, then is closed for a second time and then is opened for a second time, in order to discharge compressed gas from the second cylinder by means of a second piston of the second cylinder. As already noted, it is provided that the second cylinder and its second exhaust valve are operated like the first cylinder and the first exhaust valve. Moreover, it is provided that in the engine braking mode, within a working cycle, at least a third exhaust valve of the third cylinder is closed for a first time, then is opened for a first time, then is closed for a second time and then is opened for a second time, in order to discharge compressed gas from the third cylinder, by means of a third piston of the third cylinder. This means that also the third cylinder and its third exhaust valve are operated like the first cylinder and the first exhaust valve. In this way, a decompression brake is provided by the three cylinders, so that a particularly high engine braking power is achieved.

The first cylinder is filled with at least a portion of the gas discharged by the second cylinder, while the second exhaust valve, after its second opening, and before its first closing, is open. Moreover, the first cylinder is filled with at least a portion of the gas discharged by the third cylinder, while the third exhaust valve, after its first opening and before its second closing, is at least partially open. It is therefore provided that the second decompression cycle of the second cylinder and the first decompression cycle of the third cylinder are used for charging the first cylinder for its second decompression cycle. Thereby, during the second decompression cycle, a particularly high quantity of air is present in the first cylinder, so that a particularly high engine braking power is achieved.

It is also contemplated, that, for example, the first cylinder for its first decompression cycle, is filled with gas formed by fresh air through at least one intake channel. An intake valve associated with the intake channel is at least in its open position, so that, by moving the piston of the first cylinder from the top dead center to the bottom dead center, gas of fresh air is sucked into the first cylinder. This fresh air may then be compressed in the first decompression cycle by the first piston. The compressed fresh air flows, after the first decompression cycle, from the first cylinder. For the second decompression cycle, the first cylinder is filled with gas, which originates from the second decompression cycle of the second cylinder and from the first decompression cycle of the third cylinder.

The respective gas may flow on the exhaust side of the reciprocating internal combustion engine through at least a respective exhaust channel from the second cylinder and from the third cylinder, and into the first cylinder, through at least one exhaust channel of the first cylinder.

To this end, the three cylinders are connected fluidically to one another for example via an exhaust manifold, which is arranged on the exhaust side and serves for guiding exhaust gas or gas flowing out of the cylinders. At an instant, at which the three exhaust valves of the three cylinders are open, the three cylinders are connected via the exhaust manifold fluidically with each other, such that the described transition of the gas from the second cylinder and the third cylinder into the first cylinder can take place.

Another embodiment is characterized in that the exhaust valve of the first cylinder is held open after the first opening, at least up to 210 degrees of crank angle after top dead center, especially after ignition top dead center, of the piston of the first cylinder. The ignition top dead center of the first piston is the top dead center of the piston, in whose area, in firing operation of the reciprocating internal combustion engine, the ignition of the fuel-air mixture takes place. This ignition is obviously absent in the engine braking mode of operation, wherein the term "ignition top dead center" is merely used to distinguish this ignition top dead center from the top charge exchange dead center (TD) which is reached by the first piston during ejection of exhaust gas from the first cylinder.

Because the exhaust valve of the first cylinder is kept open up to at least 210 degrees of crank angle after top dead center, the first cylinder can be charged with a particularly high amount of gas, so that a particularly high engine braking power can be realized.

Especially advantageous is the case where the exhaust valves in the engine braking mode of operation travel less than in a normal mode of operation, different from the engine braking mode of operation, in particular traction, of the reciprocating internal combustion engine. This means that in the engine braking mode of operation, the exhaust valves are not opened at full stroke as in normal operation (fired or combustion mode). This full stroke is absent in the engine braking mode of operation. Rather, the exhaust valve is opened with a comparatively smaller stroke, both in the first opening and the second opening. It can be provided that the strokes during the first opening and the second opening are the same, or that the exhaust valve of the first cylinder during the first opening and the second opening opens with different strokes.

The invention also includes a reciprocating internal combustion engine of a motor vehicle, which is designed for performing a method according to the invention. Advantageous embodiments of the method according to the invention are to be regarded as advantageous embodiments of the reciprocating internal combustion engine and vice versa.

Further advantages, features and details of the invention will become apparent from the following description of embodiments and from the drawings. The above features and feature combinations mentioned in description, and those features and feature combinations mentioned below in the description of the figures and/or shown in the figures may be used not only in the particular combination indicated, but also in other combinations or alone, without leaving the scope of the invention.

DETAILED DESCRIPTION OF THE DRAWINGS

Figure 1:
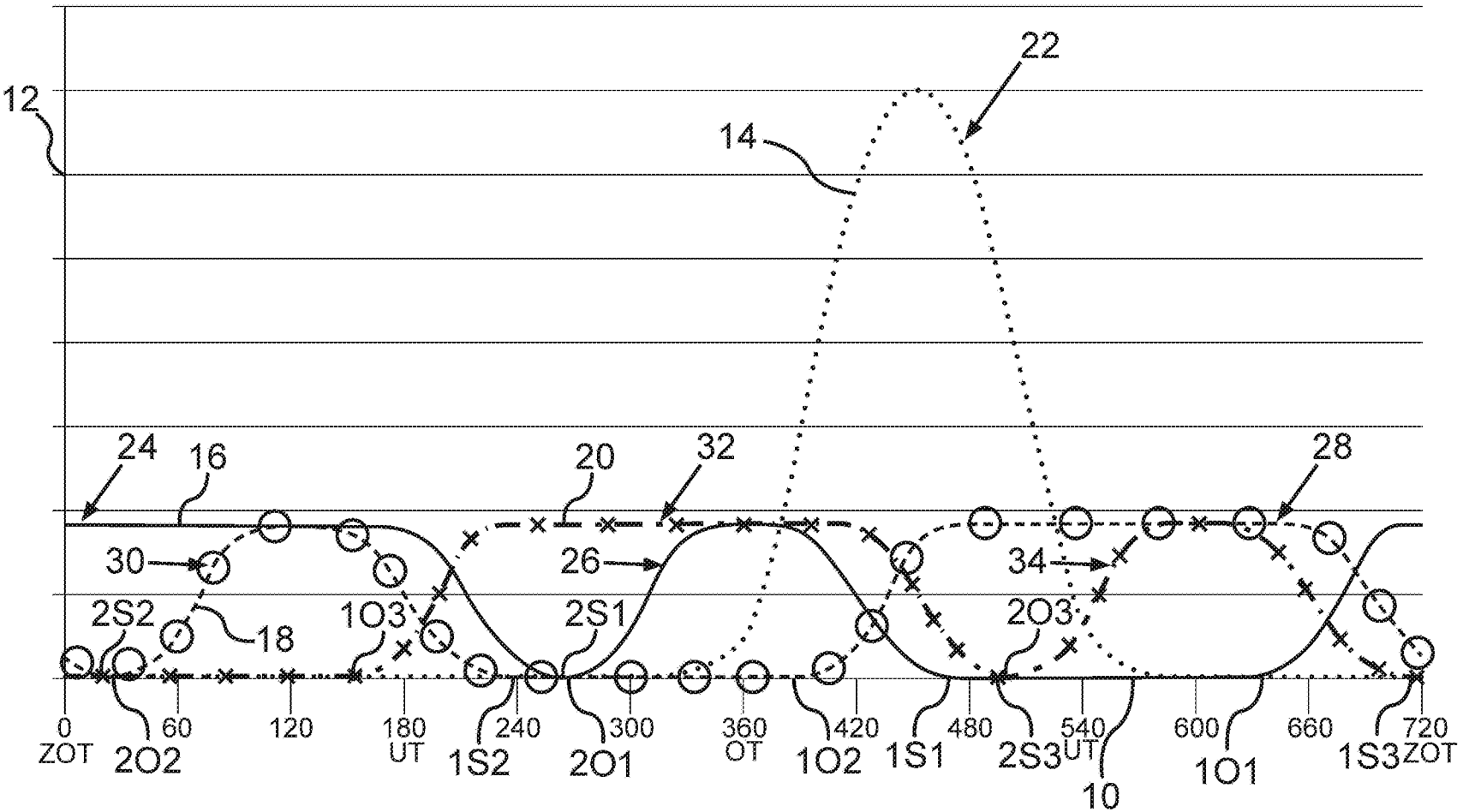
FIG. 1 depicts a diagram illustrating a method for operating a reciprocating internal combustion engine in an engine braking mode of operation, wherein three exhaust valves of respective cylinders of the reciprocating internal combustion engine perform, within a working cycle, two successive decompression strokes, to thereby realize a decompression brake with a particularly high engine braking power.

The figures serve to illustrate a method for operating a reciprocating internal combustion engine of a motor vehicle. The reciprocating internal combustion engine is used to drive the motor vehicle and includes a total of, for example, six combustion chambers in the form of cylinders. The cylinders are arranged in series. A first set of three of these cylinders is arranged in a first cylinder bank, with a second set of three of these cylinders being arranged in a second cylinder bank. The cylinder banks each have a common exhaust manifold. The method is described with reference to one of the cylinder banks that is based on three of the six cylinders, wherein the following description can be readily transferred to the other cylinders and the other cylinder bank.

In a first of the three cylinders, a first piston is arranged, wherein the first piston is translationally moved. In a second cylinder, a second piston is arranged, wherein the second piston is translationally moved. In the third cylinder, a third piston is also arranged, which is translationally moved. The three pistons are coupled by a respective connecting rod articulated to a crankshaft of the reciprocating internal combustion engine. The crankshaft is rotatably supported on a crankcase of the reciprocating internal combustion engine about a rotation axis relative to the crankcase. Due to the articulated coupling of the piston to the crankshaft, the translational movements of the pistons are transformed into a rotational movement of the crankshaft about its axis of rotation.

In a normal operation of the internal combustion engine, a fired operation of the reciprocating internal combustion engine is carried out. Under this fired operation (normal operation) liquid fuel and air are introduced into the respective cylinders. This results in (in the respective cylinder) a fuel-air mixture that is compressed.

The cylinders are associated with a respective intake channel, through which air can flow into the respective cylinders. The intake channel of the first cylinder is associated with a first intake valve which is movable between at least one closed position fluidly obstructing the intake channel of the first cylinder and at least one open position fluidly opening the intake channel of the first cylinder. Accordingly, a second intake valve is associated with the intake channel of the second cylinder, which is movable between a closed position, fluidly obstructing the intake channel of the second cylinder and at least one open position at least partially fluidly opening the intake channel of the second cylinder. Also, the intake channel of the third cylinder is associated with an intake valve which is movable between a closed position fluidly obstructing the intake channel of the third cylinder and at least one open position at least partially fluidly opening the intake channel of the third cylinder. If the respective intake valve is in its open position, air can flow through the intake channel in the cylinder.

Due to ignition and combustion of the fuel-air mixture, exhaust gas is formed in the respective cylinder. At least one exhaust channel is associated to the respective cylinder, through which the exhaust gas may flow out of the respective cylinder. A first exhaust valve is associated with the exhaust channel of the first cylinder, which is movable between a closed position fluidly obstructing the exhaust channel of the first cylinder and at least one open position, which at least partially fluidly opens the exhaust channel of the first cylinder. A second exhaust valve is associated with the exhaust channel of the second cylinder, which is movable between a closed position fluidly obstructing the exhaust channel of the second cylinder and at least one open position, which at least partially fluidly opens the exhaust channel of the second cylinder. A third exhaust valve is also associated with the exhaust channel of the third cylinder, which is movable between a closed position fluidly obstructing the exhaust channel of the third cylinder and at least one open position, which at least partially fluidly opens the exhaust channel of the third cylinder. If the respective exhaust valve is in its open position, exhaust gas may flow from the respective cylinder through the respective exhaust channel.

The air flows on a so-called intake side into the cylinder. Exhaust gas flows on a so-called exhaust or exhaust gas side out of the cylinders. On the exhaust side, an exhaust manifold is positioned, which is common to the three cylinders of the cylinder bank and which serves for guiding the out flowing exhaust gas from the cylinders. As will be explained below, the three exhaust valves can be positioned at least one time, that is at the same time, in the respective open position so that the cylinders are connected fluidically to each other via the exhaust manifold.

The intake valves and the exhaust valves are actuated, for example by means of at least one camshaft and thereby moved from the respective closed position into the respective open position and optionally held in the open position.

This is also referred to as valve timing. By the camshaft, the intake valves and the exhaust valves can be opened at predetermined instants or positions of the crankshaft. Furthermore, a respective closing of the intake valves and exhaust valves is allowed by the camshaft at predetermined points in time or rotational positions of the crankshaft.

The respective rotational positions of the crankshaft about its axis are commonly also referred to as "crank angle degrees" (°CA). The figures now show diagrams, wherein the abscissa 10 indicates the rotational positions, i.e., the crank angle degrees of the crankshaft.

The reciprocating internal combustion engine is designed as a four-stroke engine, in which a so-called working cycle of the crankshaft includes exactly two revolutions of the crankshaft. In other words, a working cycle includes exactly 720 (°CA). Within such a working cycle, that is, within 720 (°CA), the respective piston moves twice in its respective top dead center (TDC) and twice in its respective bottom dead center (BDC).

The dead center, in the region, in fired operation of the reciprocating internal combustion engine, the compressed fuel-air mixture is ignited is referred to as top dead center (TDC). In order to provide a good readability of the diagram shown in the figure, the top dead center TDC is rechanneled twice, namely once at 720 crank angle degrees and once at 0 crank angle degrees, this being the same rotational position of the crankshaft and the camshaft.

The references "BDC" for bottom dead center, "TDC" for top dead center and "ITDC" for ignition top dead center relate to the positions of the first piston. The 720 (°CA) shown in the diagrams thus relates to one working cycle of the first cylinder and the first piston. Based on this working cycle of the first piston, the second piston and the third piston reach their respective bottom dead center and their respective upper dead center or ignition top dead center at different rotational positions of the crankshaft. The following description regarding the first exhaust valve and the first intake valve refers to the respective bottom dead center BDC at 180 (°CA) and 540 (°CA), the top dead center (upper charge exchange dead center) at 360 (°CA) and the ignition top dead center ITDC of the first piston at 0 (°CA) and 720 (°CA) and can be readily referred also to the second exhaust valve of the second cylinder, however, based on the respective bottom dead center, top dead center and ignition top dead center of the second piston as well as to the third exhaust valve, however, based on the respective bottom dead center, top dead center and ignition top dead center of the third piston.

With reference to the respective working cycle of the respective cylinder, the cylinders and thus the exhaust valves and the intake valves are operated in the same way.

The diagrams also exhibit an ordinate 12, on which a respective stroke of the respective intake valve and of the respective exhaust valve is plotted. This stroke is travelled by the respective exhaust or respective intake valve, when opening and closing.

In the diagram of FIG. 1, a dashed line is a curve 14. The curve 14 characterizes the motion, that is the opening and closing of the first intake valve of the first cylinder. For clarity in the diagram, only the movement of the first intake valve of the first cylinder is shown. In the diagram a solid line is a curve 16, which characterizes the opening and closing of the first exhaust valve of the first cylinder during engine braking mode of operation. A curve 18 provided with circles characterizes the opening and closing of the second exhaust valve of the second cylinder, based on the working cycle of the first cylinder and the first piston. A curve 20 provided with crosses characterizes the opening and closing of the third exhaust valve of the third cylinder, based on the working cycle of the first cylinder. Thus, the curve 18 of the second exhaust valve of the second cylinder is represented as delayed with an offset of a 480-degree crank angle, corresponding to a firing order 1-5-3-6-2-4 of a six-cylinder in-line engine, with respect to the working cycle of the first cylinder and accordingly the curve 20 of the third exhaust valve of the third cylinder by 240 degrees of crank angle. The higher the respective curve of 14, 16, 18, and 20 is, the more the intake valve or the respective exhaust valve is opened at a corresponding rotational position (crank angle degree) of the crankshaft. If the respective curve of 14, 16, 18, and 20 is on the ordinate value "zero", the intake valve or the respective exhaust valve is closed. In other words, the curves 14, 16, 18, 20 represent respective valve lift curves of the intake valve or of the respective exhaust valves.

The process described below is performed in an engine braking mode of operation of the reciprocating internal combustion engine. In FIG. 1, curve 14 shows that the first intake valve of the first cylinder is opened in the area of the top dead center of the first piston and is closed in the area of the bottom dead center of the first piston. The first intake valve therefore performs an intake stroke 22, so that gas may flow, as fresh air, through the intake channel of the first cylinder in the same, wherein this gas is sucked in by the piston moving from the top dead center to the bottom dead center.

As is shown by curve 16, within a working cycle of the first cylinder or of the first piston, the first exhaust valve is closed twice and opened twice.

In relation to the intake 22 of the first intake valve, the first exhaust valve of the first cylinder within the working cycle of the first cylinder or of the first piston is closed for the first time at a rotational position indicated by 1S1 shortly before 480 (°CA) of the crankshaft. This rotational position 1S1 is within the intake stroke 22. Within the working cycle of the first cylinder or of the first piston, the first exhaust valve is opened for the first time shortly before 660 (°CA) of the crankshaft after the first closing at a rotational position indicated by 1O1. Subsequently, the first exhaust valve is closed for a second time at a rotational position indicated by 2S1 shortly after 240 (°CA) of the crankshaft. Thereafter, the first exhaust valve is opened for a second time at a rotational position of the crankshaft indicated by 2O1 at about 270 (°CA).

By the first closing, the fresh air in the first cylinder is compressed by the first piston. Through the first opening and the second closing, the first exhaust valve performs a first decompression stroke 24 within the working cycle of the first cylinder, so that the first cylinder performs a first decompression cycle. In this case, through the first opening (at 1O1), the fresh air, previously compressed by the first piston or the gas previously compressed by the first piston is discharged from the first cylinder through the exhaust channel of the first cylinder, without using the compression energy stored in the compressed gas, for moving the first piston from its top dead center to its bottom dead center. Since the reciprocating internal combustion engine had to provide energy for compressing the gas in a previous moment, this therefore causes a braking of the reciprocating internal combustion engine and therefore of the motor vehicle. Due do the second opening at rotational position 2O1, and the first closing 1S1, the first exhaust valve performs a second decompression stroke 26 within the working cycle of the first cylinder, so that the first cylinder performs a second decompression cycle.

In this second decompression stroke 26, i.e., second decompression cycle, within the working cycle of the first cylinder or piston, gas, which was compressed by the first piston in the first cylinder is discharged for a second time through the exhaust channel of the first cylinder, without the possibility to use the compression energy stored in this gas for moving the piston from the top dead center to the bottom dead center. In this way, in the engine braking mode of operation, a particularly high braking power may be achieved, i.e., a particularly high engine braking power.

In the engine braking mode of operation, the first exhaust valve and the second and third exhaust valves perform a substantially lower stroke as in normal operation, that is during fired operation of the reciprocating internal combustion engine.

Curve 18 in the figure also shows that in the engine braking mode of operation within a working cycle of the second cylinder or of the second piston, the second exhaust valve of the second cylinder is closed for the first time at a rotational position of the crankshaft designated as 1S2. With respect to the intake stroke of the second intake valve of the second cylinder, not shown in the figure, this first opening is also carried out in the area of the intake stroke of the second intake valve, and in particular within the intake stroke of the second intake valve. Within the working cycle of the second cylinder, the second exhaust valve is opened for the first time after the first closing at a rotational position of the crankshaft designated as 1O2. Subsequently, the second exhaust valve is closed a second time at a rotational position of the crankshaft designated as 2S2, and then opens again for a second time in a rotational position of the crankshaft within the working cycle of the second cylinder designated as 2O2. Through the first opening (at rotational position 1O2) and the second closing (at rotational position 2S2) of the second exhaust valve, the second exhaust valve performs a first decompression stroke 28. Through the second opening and the first closing, the second exhaust valve performs, within the working cycle of the second cylinder, a second decompression stroke. By first closing the second exhaust valve, gas is compressed in the form of fresh air, which was sucked in as a result of opening of the second intake valve of the second piston into the second cylinder. In the curve of the first decompression stroke 28 of the second exhaust valve, that is to say in the curve of a first decompression cycle of the second cylinder, the compressed gas is discharged via the second exhaust channel from the second cylinder, so that compression energy stored in the compressed gas cannot be utilized to move the second piston from its top dead center back to its bottom dead center. This process is repeated during the second decompression stroke 30, so that the second cylinder also performs two decompression cycles within a working cycle of the second cylinder.

The same applies to the third cylinder. In the engine braking mode of operation within a working cycle of the third cylinder or of the third piston—as can be seen from the curve 20—a first closing is performed at a rotational position of the crankshaft designated as 1S3. Subsequently—within the working cycle of the third cylinder—the third exhaust valve opens for the first time at a rotational position of the crankshaft designated as 1O3. Thereafter, the third exhaust valve is closed for a second time at a rotational position of the crankshaft designated as 2S3. Subsequently, the third exhaust valve is opened for a second time at a rotational position of the crankshaft designated 2O3. Through the first opening (at rotational position 1O3) and the second closing (at rotational position 2S3) the third exhaust valve performs, within a working cycle, a first decompression stroke 32, so that the third cylinder performs a first decompression cycle. As in the first cylinder and the second cylinder, the rotational position 1S3, at which the third exhaust valve is closed for the first time within the working cycle of the third cylinder or the third piston, lies also in the same area, and preferably within the intake stroke of the intake valve of the third cylinder. As a result of the first closing of the third exhaust valve—as with the first cylinder and the second cylinder—gas in the form of fresh air, which has been sucked in through the opening of the third intake valve into the third cylinder by means of the third piston, is compressed by means of the third piston. Through the first opening (at rotational position 1O3) of the third exhaust the compressed gas is discharged from the third cylinder, so that compression energy stored in the compressed gas cannot be used to move the third piston from its top dead center to its bottom dead center.

Through the second opening (at rotational position 2O3) and the first closing (at rotational position 1S3) the third exhaust valve performs within the working cycle of the third cylinder a second decompression stroke 34, wherein during the second decompression stroke 34 of the third exhaust valve, the third cylinder performs a second decompression cycle. Also in the second decompression cycle, compressed gas is discharged through the third exhaust channel from the third cylinder so that the compression energy stored in the compressed gas cannot be used to move the third piston from the top dead center into the bottom dead center. As the first exhaust valve within the working cycle of the first cylinder and the second exhaust valve within the working cycle of the second cylinder, the third exhaust valve of the third cylinder performs within the working cycle of the third cylinder two decompression strokes 32, 34 which are sequentially executed within the working cycle of the third cylinder. Thus, the three cylinders perform within their respective working cycle two consecutive decompression cycles, yielding extremely high engine braking power in the engine braking mode of operation.

The degree of crank angle at which the second and third exhaust valve respectively open and close are correspondingly offset by 240 (°CA) or 480 (°CA) with respect to the first cylinder.

To obtain now a particularly high engine braking power during engine braking mode of operation, it is contemplated that the first exhaust valve of the first cylinder is held open after the first opening (at rotational position 1O1) and before the second closing (at rotational position 2S1) after the first performed decompression until the first cylinder is filled again with a gas flowing on the exhaust side via the second exhaust channel from the second cylinder, and with gas flowing on the exhaust side from the third cylinder through the third exhaust channel. Based on the curve 16, it can be seen that the first exhaust valve is kept open until just after 240 degrees of crank angle after top dead center ITDC of the first piston or is completely closed just after 240 degrees crank angle after top dead center ITDC. In relation to the working cycle of the first cylinder, the second decompression stroke 30 of the second exhaust valve—as is shown in FIG. 1—is still completely within the first decompression stroke 24 of the first exhaust valve. The first decompression stroke 32 of the third exhaust valve is also partially inside both the second decompression stroke 30 and inside the first decompression stroke 24, since the third exhaust valve—with respect to the working cycle of the first cylinder—is opened already before 180 degrees of crank angle after the top ignition dead center of the first piston. This means that all three exhaust valves are opened temporarily at the same time at the rotational position 1O3 through the first opening of the third exhaust valve, so that the cylinders are fluidly connected to each other via the exhaust manifold. In this way, the first cylinder may be charged with gas from the second cylinder and from the third cylinder for the second decompression cycle (decompression stroke 26) following the first decompression cycle (decompression stroke 24), whereby a particularly high engine braking power is obtained. The first cylinder is thereby filled for this second decompression with gas from the second decompression cycle of the second cylinder and with gas from the first decompression cycle of the third cylinder.

The first exhaust valve should be kept open after first opening 1O1 and before the second closing 2S1 at least until the first cylinder is filled with gas flowing through at least one exhaust channel from at least one second cylinder of the reciprocating internal combustion engine. This means that the first cylinder should be filled with gas of the second or third cylinder at least and thus the first cylinder is only filled with gas by another cylinder.

This principle can also be transferred easily to the second cylinder and the third cylinder. This means that, for example, the second cylinder for its second decompression cycle within the working cycle of the second cylinder is filled that is it's being charged with gas from the first cylinder and with gas from the third cylinder. The third cylinder is charged within the working cycle of the third cylinder for the second decompression cycle with gas from the first cylinder and with gas from the second cylinder. This is advantageous because—as can be seen for example from the figure based on the first cylinder—after the intake stroke 22 of the first intake valve and before the second decompression cycle or before the second decompression stroke 26, no intake stroke is performed by the first intake valve. This means that the first cylinder after the intake stroke 22 and before the second decompression cycle may not be filled with gas via the intake channel of the first cylinder. Therefore, it is intended to fill the first cylinder with gas for its second decompression cycle via the exhaust channel of the second cylinder, which gas comes from both the second cylinder as well as from the third cylinder.

Thus, there is an overlap between the second closing of the first exhaust valve and—based on the working cycle of the third cylinder—the first opening of the third exhaust valve. Advantageously, by the overlapping of the respective first opening of a first exhaust valve and a second closing of a third exhaust valve and/or the first closing of a second exhaust valve, pressure peaks in the exhaust manifold may be reduced through overflowing of gas from the first into the third and/or second cylinder. Also, due to the overlapping of the respective second opening of a first exhaust valve with the first decompression stroke of the third exhaust valve, pressure peaks in the exhaust manifold may be avoided due to the overflow of gas from the first into the third cylinder. Further an overlap between the first opening of the third exhaust valve and—based on the working cycle of the second cylinder—the first closing of the second exhaust valve takes place. Further, the second closing of the first exhaust valve occurs after the first closing of the second exhaust valve so that both gas from the second cylinder as well as gas from the third cylinder may flow into the first cylinder. Thus, the first cylinder is charged two times, that is, with gas from the second cylinder and with gas from the third cylinder.

Figure 2:
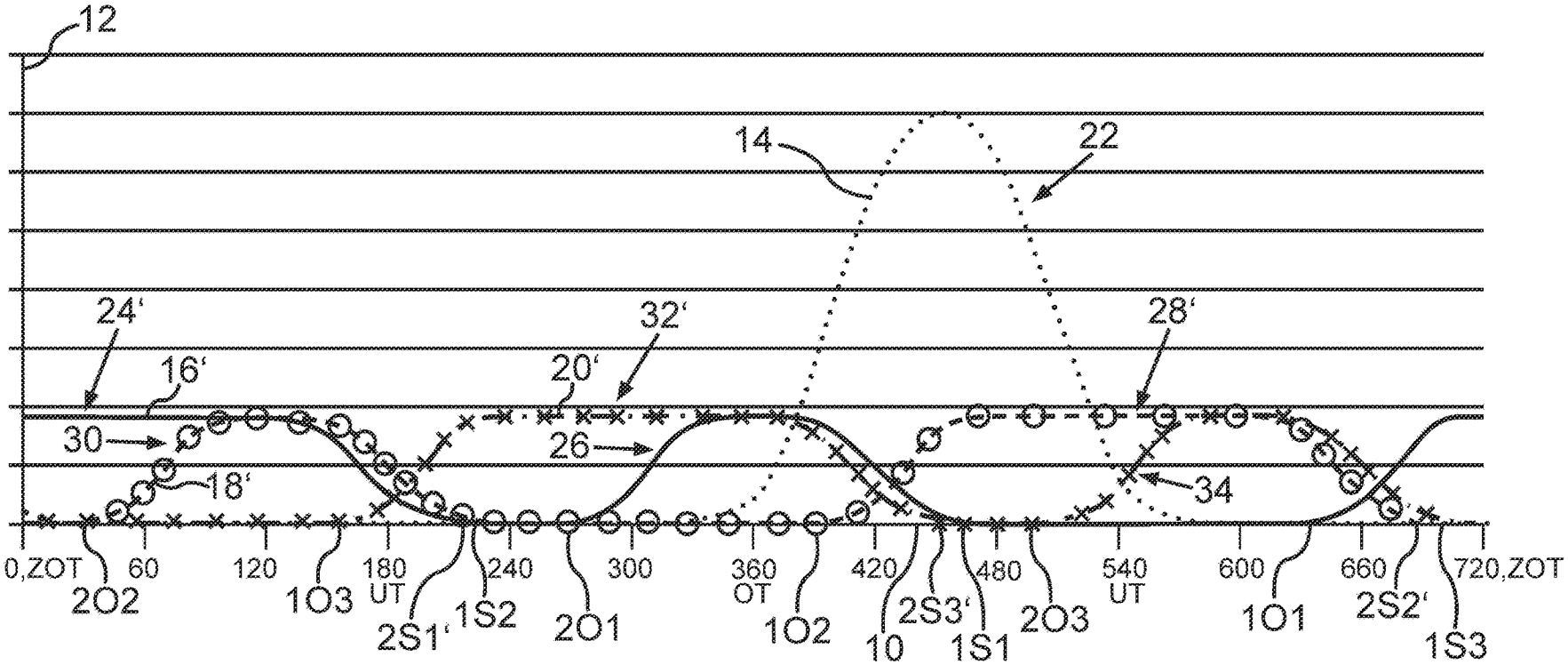
FIG. 2 depicts an alternative embodiment of FIG. 1.

In FIG. 2, an alternative embodiment of FIG. 1 is shown. The same lines and same points are provided in FIG. 2 with the same reference numerals as in FIG. 1. In the diagram of FIG. 2 the unchanged curve 14 of FIG. 1 is plotted. The curves 16', 18' and 20' have, in contrast to FIG. 1, respectively earlier closing times of first decompression strokes 24', 28' and 32'. The second closing 2S1' 2S2' and 2S3' of the first decompression strokes 24', 28' and 32' takes place 30 degrees crank angle earlier; thus, for example, the first exhaust valve closes at about 210 degrees crank angle and the first closing timings 1S1, 1S2 and 1S3 of the second, unchanged decompression strokes 26, 30, 34 are temporally successive to the second closing 2S1' 2S2' and 2S3' of the first decompression strokes 24', 28' and 32'.

Figure 3:
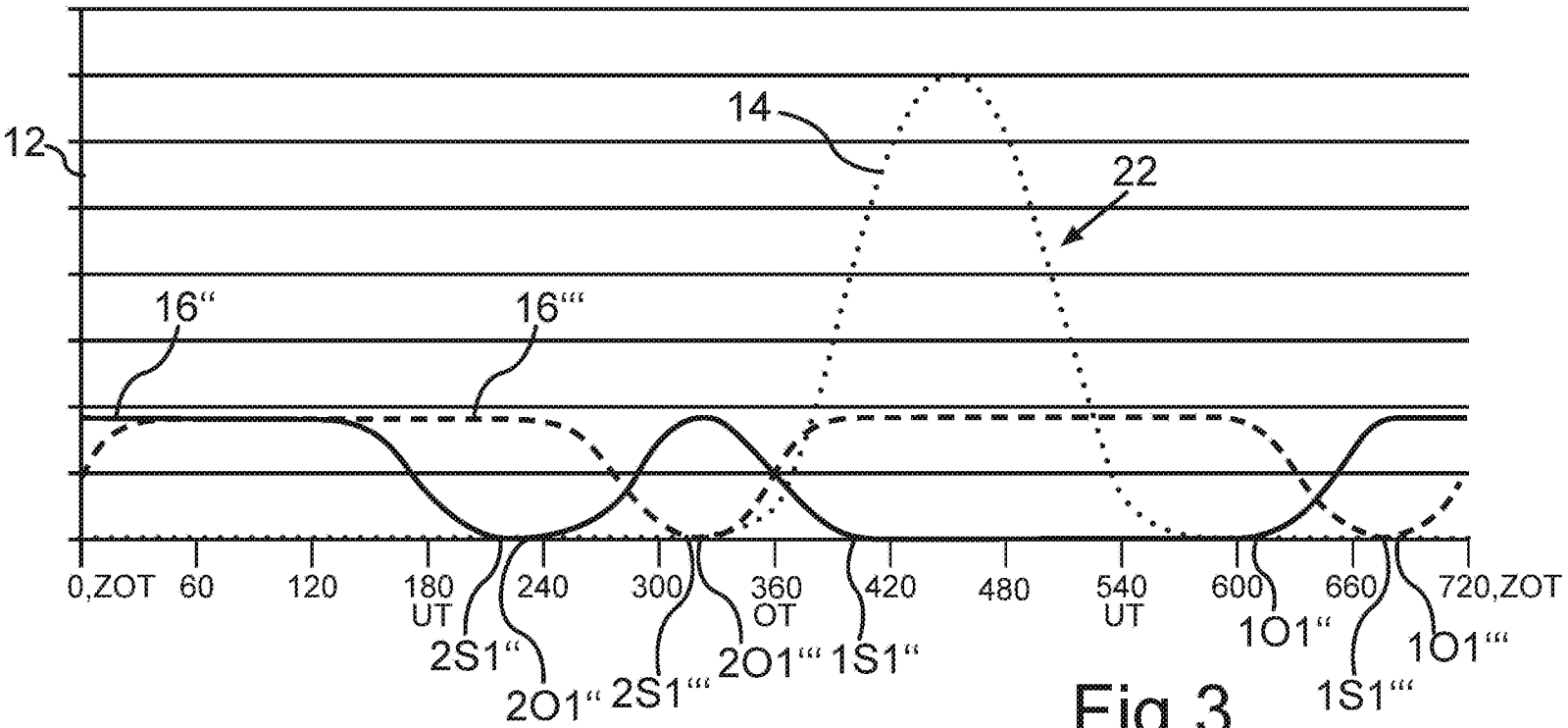
FIG. 3 depicts a diagram illustrating preferred ranges of the respective opening and closing times of the two successive decompression strokes, on the basis of a first exhaust valve.

In FIG. 3, a graph illustrating preferred ranges of the respective opening and closing times of the two successive decompression strokes is illustrated by way of the first exhaust valve. The following description is also readily applicable to the other cylinders and the other cylinder banks. The same lines and same points are provided in FIG. 3 with the same reference numerals as in FIG. 1 and FIG. 2. In the diagram of FIG. 2 the unchanged curve 14 of FIG. 1, is plotted. Furthermore, in FIG. 3 two curves 16" (solid line) and 16'" (dashed line) of the first exhaust valve are shown, which indicate, by curve 16", the earliest possible opening times 1O1" at about 610 degrees of crank angle and 2O1" at about 250 degrees crank angle and closing times 1S1" at about 400 degrees crank angle and 2S1" at about 210 degrees crank angle. Accordingly, the curve 16'" indicates the latest possible opening time points 1O1'" at about 680 degrees crank angle and 2O1'" at about 320 degrees crank angle and closing times 1S1'" at about 680 degrees crank angle and 2S1'" at about 320-degree crank angle. The resulting areas of possible first and second opening times and of first and second closing times are combined with one another.

The invention claimed is:

1. A method for operating a reciprocating internal combustion six-cylinder engine in an engine braking mode of operation, where the engine includes a first cylinder bank with a first set of three cylinders in a row and a second cylinder bank with a second set of three cylinders in a row, and each of the first and second cylinder banks has its own common exhaust manifold, the method comprising the steps of:

closing, for a first time, at least one exhaust valve of a first cylinder in the engine braking mode of operation within a working cycle, and opening for a first time the at least one exhaust valve within the working cycle, and closing, for a second time, the at least one exhaust valve of the first cylinder within the working cycle, and opening for a second time the at least one exhaust valve to thereby discharge compressed gas in the first cylinder via a piston from the first cylinder within the working cycle, and wherein after the first opening and before the second closing of the at least one exhaust valve, the at least one exhaust valve is kept open, until the first cylinder is filled with respective gas which flows through at least one respective exhaust channel introduced from a second cylinder and a third cylinder of the reciprocating internal combustion engine, the first, second, and third cylinders being different from one another and the gas from the second and third cylinders charges the first cylinder while the first, second, and third cylinders have a respective exhaust valve open simultaneously, wherein the at least one exhaust valve of the first cylinder after the first opening is at least partially kept open until 210 degrees of crank angle after top dead center (TDC), and wherein the reciprocating internal combustion engine is operated in an unfired condition without fuel injection during the engine braking mode of operation.

2. The method according to claim 1, further comprising:

closing, for a first time, at least a second exhaust valve of the second cylinder in the engine braking mode of operation within a working cycle of the second cylinder, and opening the at least a second exhaust valve for a first time, and closing, for a second time, the at least a second exhaust valve of the second cylinder, and opening the at least a second exhaust valve for a second time thereby discharging compressed gas in the second cylinder from the second cylinder via a second piston of the second cylinder, and wherein the first cylinder is filled with at least a portion of the gas discharged from the second cylinder while the at least a second exhaust valve, after the second opening and before the first closing or after the first opening and before the second closing is at least partially open.

3. The method according to claim 1, further comprising:

closing, for a first time, at least a second exhaust valve of the second cylinder in the engine braking mode of operation within a working cycle of the second cylinder, and opening the at least a second exhaust valve for a first time, and closing, for a second time, the at least a second exhaust valve of the second cylinder, and opening the at least a second exhaust valve for a second time thereby discharging compressed gas in the second cylinder from the second cylinder via a second piston of the second cylinder, and closing, for a first time, at least a third exhaust valve of the third cylinder in the engine braking mode of operation within a working cycle of the third cylinder, and opening the at least a third exhaust valve for a first time, and closing, for a second time, the at least a third exhaust valve of the third cylinder, and opening the at least a third exhaust valve for a second time to thereby discharge via a third piston of the third cylinder compressed gas in the third cylinder from the third cylinder, wherein the first cylinder is filled with at least a part of the gas discharged from the second cylinder, while the at least a second exhaust valve to its second opening and before the first closing is open and wherein the first cylinder having at least one part of the discharged from the third cylinder gas is filled, while after the first opening and the second closing, and the at least a third exhaust valve is at least partially open.

4. The method according to claim 1, wherein the exhaust valves in the engine braking mode of operation perform a smaller stroke than in a normal mode of operation different from the engine braking mode of operation.

5. The method according to claim 4, wherein the normal mode of operation is a traction operation of the reciprocating internal combustion engine.

6. A reciprocating internal combustion engine for a motor vehicle, which is configured for performing a method according to claim 1.

* * * * *